US009163796B2

(12) United States Patent
Moshtagh

(10) Patent No.: US 9,163,796 B2
(45) **Date of Patent: *Oct. 20, 2015**

(54) LOW PROFILE HEAT SINK WITH ATTACHED LED LIGHT SOURCE

(71) Applicant: Bridgelux, Inc., Livermore, CA (US)

(72) Inventor: Vahid S. Moshtagh, Fremont, CA (US)

(73) Assignee: Bridgelux, Inc., Livermore, CA (US)

( * ) Notice: Subject to any disclaimer, the term of this patent is extended or adjusted under 35 U.S.C. 154(b) by 26 days.

This patent is subject to a terminal disclaimer.

(21) Appl. No.: 14/098,835

(22) Filed: Dec. 6, 2013

(65) Prior Publication Data

US 2014/0092609 A1 Apr. 3, 2014

Related U.S. Application Data

(63) Continuation of application No. 13/373,347, filed on Nov. 12, 2011, now Pat. No. 8,628,217.

(51) Int. Cl.

| | |
|---|---|
| ***F21V 29/00*** | (2015.01) |
| ***F21S 8/08*** | (2006.01) |
| ***F21V 31/00*** | (2006.01) |
| ***F21V 29/71*** | (2015.01) |
| ***F21V 29/74*** | (2015.01) |
| ***F21V 29/75*** | (2015.01) |
| ***F21V 29/83*** | (2015.01) |
| *F21V 3/00* | (2015.01) |
| *F21K 99/00* | (2010.01) |
| *F21W 131/103* | (2006.01) |
| *F21Y 101/02* | (2006.01) |

(Continued)

(52) U.S. Cl.

CPC ..... *F21S 8/085* (2013.01); *F21V 29/004* (2013.01); *F21V 29/713* (2015.01); *F21V 29/74* (2015.01); *F21V 29/75* (2015.01); *F21V 29/83* (2015.01); *F21V 31/005* (2013.01); *F21K 9/90* (2013.01); *F21S 8/086* (2013.01); *F21V 3/00* (2013.01); *F21V 29/20* (2013.01); *F21V 29/763* (2015.01); *F21W 2131/103* (2013.01); *F21Y 2101/02* (2013.01); *F21Y 2105/001* (2013.01); *Y10T 29/49002* (2015.01)

(58) Field of Classification Search

CPC ..... F21V 29/0004; F21V 29/2212; F21V 31/005; F21V 31/00; F21W 2131/103

USPC ..... 362/294, 373, 267, 249.02, 362, 363

See application file for complete search history.

(56) References Cited

U.S. PATENT DOCUMENTS

| | | | | |
|---|---|---|---|---|
| 5,782,555 | A | 7/1998 | Hochstein | 362/373 |
| 7,104,926 | B2 * | 9/2006 | Carlson | 482/10 |
| 7,278,761 | B2 | 10/2007 | Kuan | 362/294 |

(Continued)

*Primary Examiner* — Peggy Neils

(74) *Attorney, Agent, or Firm* — Imperium Patent Works; Darien K. Wallace

(57) ABSTRACT

An LED light source with an attached heat sink includes larger fins, smaller fins, a mounting platform and light emitting diodes attached to the mounting platform. The larger fins are oriented parallel to the smaller fins. The larger fins are integrally formed with a first base, and the smaller fins are integrally formed with a second base. The bottom surface of the second base contacts the larger fins, which are more than twice as tall as the smaller fins. There are more than twice as many smaller fins than larger fins per distance perpendicular to the fins. Ducts are formed between the larger fins and the bottom surface of the second base. Intake holes pass through the first base into each duct near the end of the duct that is blocked by an end wall. The mounting platform with the LEDs is attached to the bottom of the first base.

20 Claims, 9 Drawing Sheets

(51) Int. Cl.
*F21Y 105/00* (2006.01)
*F21V 29/76* (2015.01)

(56) References Cited

U.S. PATENT DOCUMENTS

| | | | | |
|---|---|---|---|---|
| 7,641,363 | B1 | 1/2010 | Chang et al. | 362/294 |
| 7,744,247 | B2 | 6/2010 | Zhang et al. | 362/249.02 |
| 7,762,690 | B2 * | 7/2010 | Li et al. | 362/294 |
| 7,784,970 | B2 | 8/2010 | Sun | 362/294 |
| 7,837,362 | B2 * | 11/2010 | Zhang | 362/373 |
| 7,922,372 | B2 | 4/2011 | Li | 362/373 |
| 8,177,398 | B2 | 5/2012 | Yao | 362/373 |
| 8,201,976 | B2 | 6/2012 | Cho et al. | 362/294 |
| 8,237,381 | B2 * | 8/2012 | Harbers et al. | 315/312 |
| 8,272,765 | B2 * | 9/2012 | Ter-Hovhannisyan | 362/294 |
| 2008/0089071 | A1 | 4/2008 | Wang | 362/294 |
| 2009/0323348 | A1 | 12/2009 | Shuai et al. | 362/294 |
| 2010/0103668 | A1 | 4/2010 | Lueken et al. | 362/234 |
| 2010/0202136 | A1 * | 8/2010 | Vittozzi | 362/183 |
| 2011/0026251 | A1 * | 2/2011 | Liu et al. | 362/249.02 |
| 2011/0044038 | A1 * | 2/2011 | Mo | 362/235 |

* cited by examiner

LOW PROFILE HEAT SINK WITH ATTACHED LED LIGHT SOURCE

CROSS REFERENCE TO RELATED APPLICATIONS

This application is a continuation of, and claims priority under 35 U.S.C. §120 from, nonprovisional U.S. patent application Ser. No. 13/373,347 entitled "Low Profile Heat Sink With Attached LED Light Source," filed on Nov. 12, 2011, the subject matter of which is incorporated herein by reference.

TECHNICAL FIELD

The present invention relates generally to heat sinks and, more specifically, to a heat sink with an attached LED that hangs externally from a street lamp.

BACKGROUND INFORMATION

Light emitting diodes (LEDs) provide an energy-efficient light source and are increasingly being used instead of fluorescent and halogen gas lamps for high capacity lighting needs, such as street lamps. In order to increase the amount of light generated, LEDs are often incorporated into street lamps, which can lead to significant problems of overheating. The performance and lifetime of the LEDs is degraded if the operating temperature exceeds a threshold level. The useful life of an LED street lamp is sometimes specified as the number of hours of operation before which the luminous output of the lamp drops to half of its initial output. Empirical data suggests that there is an inverse exponential relationship between the useful life of an LED lamp and the amount by which the average operating temperature exceeds a threshold level. For example, some phosphors in LEDs have been found to degrade if the temperature of the phosphor exceeds 165 degrees Celsius over an extended period. Thus, dissipating the heat generated by the LEDs in the street lamp is a problem that must be solved.

The LEDs of a street lamp are enclosed by the shell of the street lamp. The shell typically has a metal upper cover and a transparent lower cover. The shell typically has openings at the top that allow the heat generated by the LEDs to escape. However, the openings at the top allow dust, moisture and insects to enter the shell, which can accumulate in the transparent lower cover and block much of the light that is generated by the LEDs.

FIG. 1 (prior art) shows an existing LED street light 10 that does not permit dust, moisture and insects to obstruct the transparent lower cover 11 through which the generated light shines onto the street. Transparent lower cover 11 is kept free of dust, moisture and insects by completely sealing off the lower compartment of the shell of the street lamp. Consequently, most of the heat generated by the LEDs must be dissipated through the upper compartment. The heat is transmitted from the LEDs to a heat conducting plate 12. The heat then passes on to heat-dissipating fins 13 via a heat guiding piece 14. Heat is dissipated out of the upper compartment by fans 15 that blow heated air out of venting slots 16 in the upper cover 17. For additional details on this prior art method of dissipating heat from a street lamp, see U.S. Pat. No. 7,278,761 to Kuan entitled "Heat Dissipating Pole Illumination Device."

This prior art method of dissipating heat from an LED street light has multiple disadvantages. First, although dust, moisture and insects are prevented from entering the lower compartment of the street lamp shell, they will nevertheless enter the upper compartment through the venting slots 16 in the upper cover 17. The dust, moisture and insects that fall through the venting slots 16 will collect in the upper compartment and clog the fans 15 and the spaces between the fins 13, thereby reducing the ability of street lamp to dissipate heat. Second, the fans 15 have moving parts and will likely malfunction, especially if they are subjected to the dust, moisture and insects that enter through the venting slots 16. Moreover, the fans 15 also require a power supply, which might not be able to be shared with the LEDs. Finally, the fans 15 add to the cost of the street lamp.

A method is sought for dissipating heat from an LED street lamp that does not allow dust, moisture and insects to enter through venting slots in the upper cover of the street lamp and that does not require fans.

SUMMARY

A conventional street lamp is retrofitted by externally mounting an LED light source with an attached heat sink. The heat sink has a very low height profile and hangs inconspicuously with the LED light source just below the space otherwise occupied by the lens of the street lamp. The heat sink light source includes a first fin structure with larger fins, a second fin structure with smaller fins, a bulb, a mounting platform and light emitting diodes attached to the mounting platform. The larger fins are oriented parallel to the smaller fins. The larger fins are integrally formed with a first base, and the smaller fins are integrally formed with a second base. The bottom surface of the second base contacts the larger fins. The larger fins are more than twice as tall as the smaller fins, and there are more than twice as many smaller fins as there are larger fins across the same distance perpendicular to the fins. Ducts are formed between the larger fins and the bottom surface of the second base. One end of each duct is blocked by an end wall, and intake holes pass through the first base into each duct near the end wall.

The mounting platform with the LEDs is attached to the bottom of the first base. The bulb is attached to the bottom surface of the first base such that the mounting platform and the LEDs are enclosed by the bulb and the bottom surface. The ambient air is expelled from the enclosure, and the enclosure is filled with an inert gas in order to protect the LEDs from degradation. The enclosure is then hermetically sealed. Heat that is generated by the LEDs is conducted through the mounting platform, the first base and the larger fins into the air in the ducts. The expanding heated air exits the ducts through the open ends opposite the end wall and draws cooler air into the ducts through the intake holes. By transferring heat away from the LEDs without using fans and without requiring venting slots in the upper cover of the street lamp, the externally mounted heat sink prevents the LEDs from operating at excessively high temperatures and protects the LEDs and associated phosphor from degradation.

A replaceable LED light bulb that can be used to retrofit a conventional street lamp is removably attached to a heat sink that is permanently attached to the street lamp. The LED light bulb includes a base, a bulb, a gasket, a mounting platform and LEDs attached to the mounting platform. The mounting platform is attached to the base. The thermal pad completely covers the mounting platform and a portion of the outside surface of the base. The surface of the mounting platform opposite the LEDs is substantially coplanar with the portion of the outside surface of the base covered by the thermal pad.

A chamber that contains the LEDs is formed between the base and the bulb. The chamber is filled with an inert gas and then hermetically sealed. The gasket is disposed in a groove in the outside surface of the base. The gasket forms an air-tight boundary between the outside surface of the base and the heat sink such that no gas that exits the chamber over time through the base and around the mounting platform may escape beyond the boundary of the gasket.

A method of manufacturing a replaceable LED light bulb includes attaching a mounting platform to a base of the LED light bulb, covering the mounting platform with a thermal pad, attaching a bulb to the base to form a chamber, and filling the chamber with an inert gas. The mounting platform with attached LEDs is attached to the base of the LED light bulb. Thermal grease is then used to attach the thermal pad to the surface of the mounting platform opposite the LEDs. The entire mounting platform and a portion of the outside surface of the base are covered by the thermal pad. The bulb is attached to the base opposite the outside surface such that a chamber is formed between the base and the bulb. The chamber is filled with an inert gas, such as argon, and is then hermetically sealed. The gasket is inserted into a groove in the outside surface of the base. The base is then removably attached to a heat sink such that the gasket forms a boundary between the outside surface of the base and the heat sink through which none of the inert gas that may exit the chamber over time through the base and around the mounting platform may escape beyond the boundary.

Further details and embodiments and techniques are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
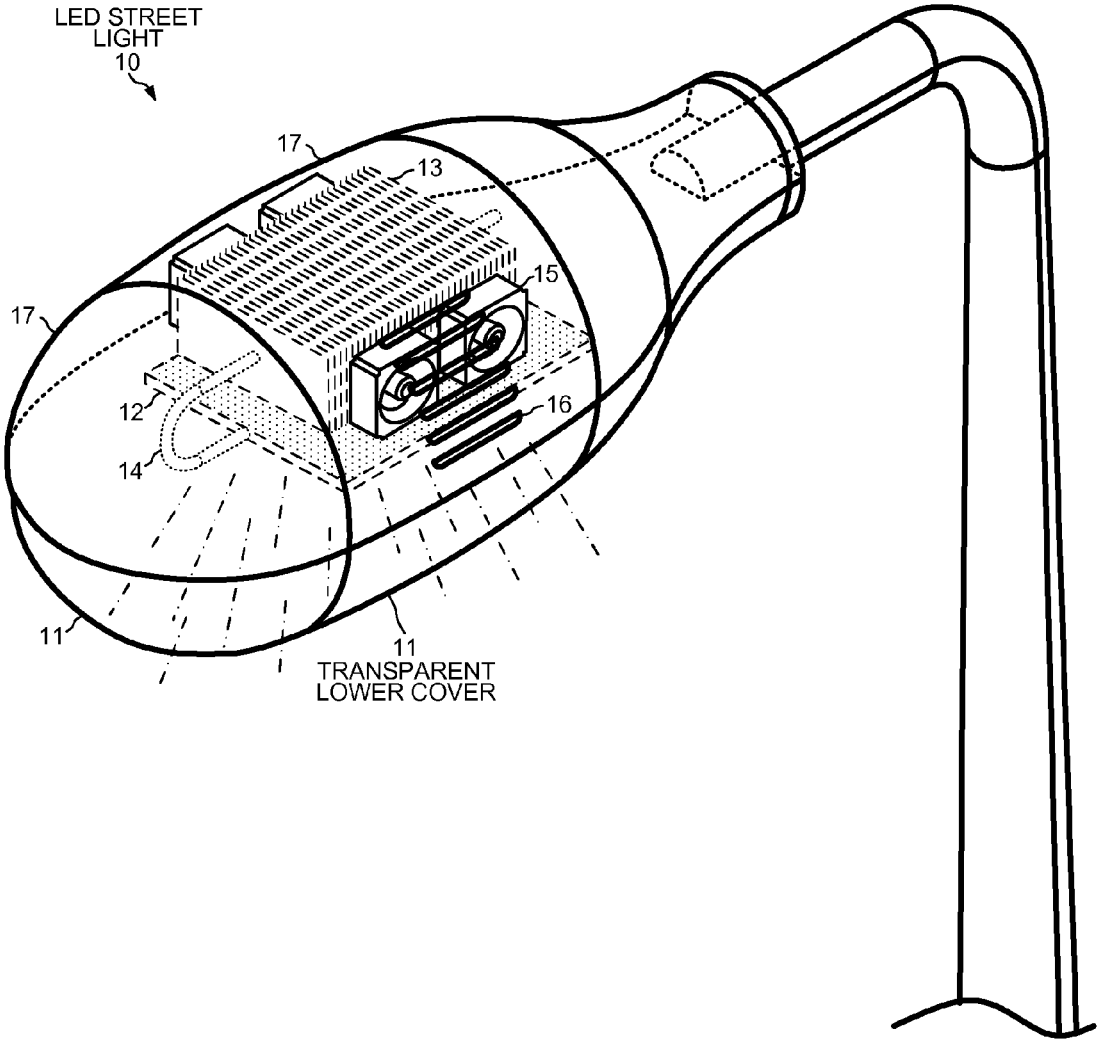
FIG. 1 (PRIOR ART)
FIG. 1 (prior art) is a perspective view of an existing LED street lamp that dissipates heat by blowing hot air out the top through venting slots.
Figure 2:
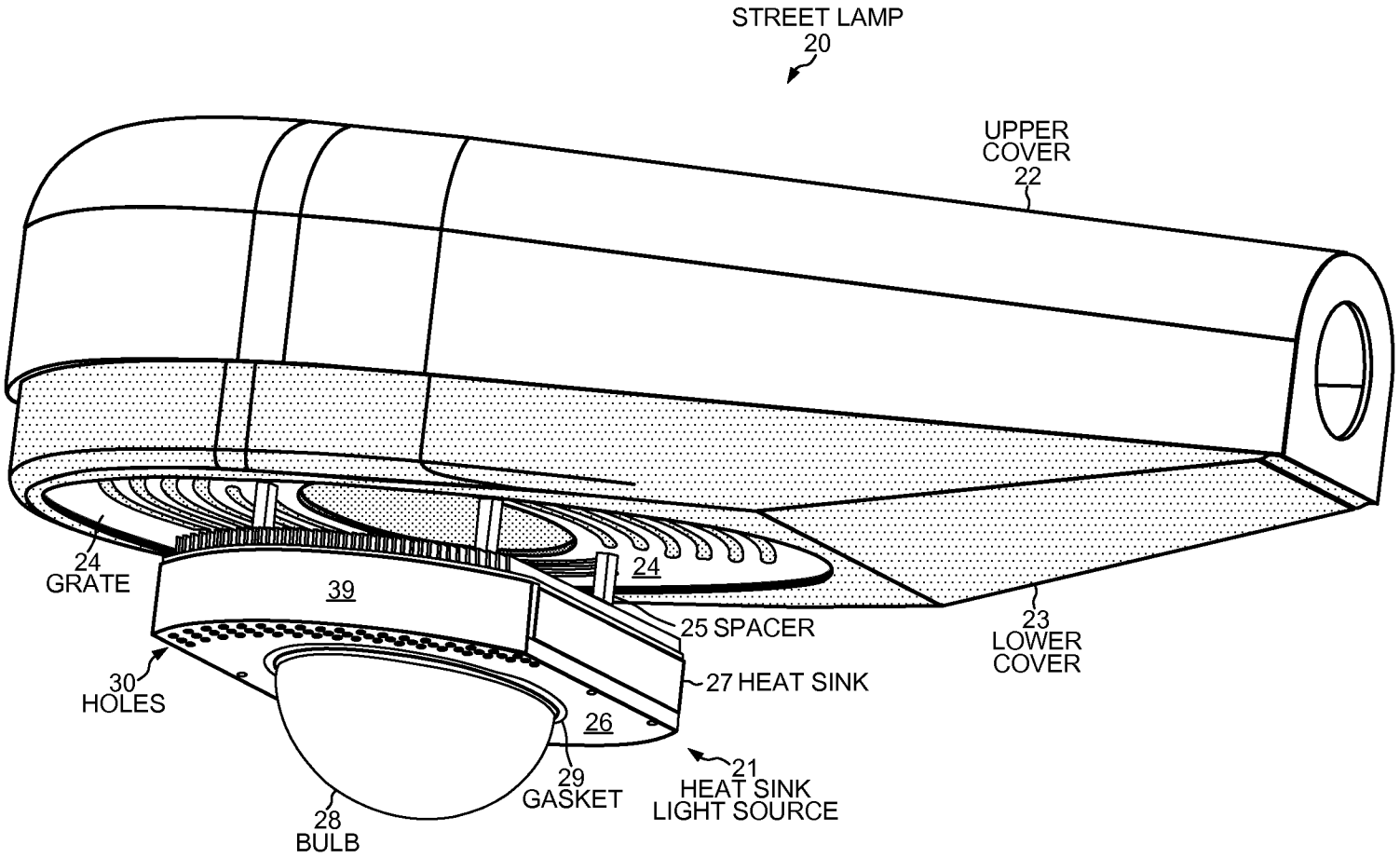
FIG. 2 is a perspective side view of a retrofitted street lamp with an externally mounted LED light source and attached heat sink.

FIG. 2 is a perspective side view of a retrofitted street lamp 20 to which an LED light source with attached heat sink 21 has been externally mounted. FIG. 2 shows the shell of a GE M400 cobrahead-style luminaire, but retrofitted street lamp 20 can be the shell of any conventional mercury vapor, sodium or metal halide street lamp that is retrofitted with an LED light source. The shell of street lamp 20 includes an upper cover 22 and a lower cover 23. The conventional light source and the lens have been removed from street lamp 20. Heat sink light source 21 hangs from a grate 24 that is attached on the inside of the lip around the opening in lower cover 23 into which the removed lens originally fit. Grate 24 bolts into lower cover 23 from the inside. Heat sink light source 21 is attached to grate 24 by four spacers 25.

Heat sink light source 21 includes multiple light emitting diodes (LEDs) attached to a bottom surface 26 of heat sink 27. Heat sink 27 has a very low height profile for the amount of heat dissipated, which permits heat sink light source 21 to fit externally yet inconspicuously under the shell of retrofitted street lamp 20. The LEDs are packaged as an array and are encapsulated by a bulb 28. Bulb 28 is attached to bottom surface 26 through a gasket 29. In one embodiment, bulb 28 is made of transparent polycarbonate. Bulb 28 can also be made of glass or plexiglass (poly[methyl methacrylate]). Gasket 29 has adhesive on both sides, such that one side sticks to bottom surface 26 and the other side sticks to bulb 28. The electrical drivers for the LEDs are housed in the shell of street lamp 20. In one embodiment, the wires that power the LEDs pass through gaps in gasket 29. In another embodiment, the wires that provide electricity to the LEDs pass from the shell through hollow spacers 25, through heat sink 27 and into the enclosure formed by bulb 28. In yet another embodiment, the wires that provide electricity to the LEDs simply drop loosely through the center hole in grate 24, through holes in heat sink 27, and then into the enclosure formed by bulb 28. Likewise, the openings through which bulb 28 is filled with an inert gas and through which ambient air is expelled from bulb 28 can also pass through gasket 29 or through bottom surface 26 of heat sink 27. FIG. 2 shows the holes 30 in bottom surface 26 of heat sink 27 through which ambient air is drawn into heat sink 27 as heated air exists from the other side (towards the back in FIG. 2) of heat sink 27.

Figure 3:
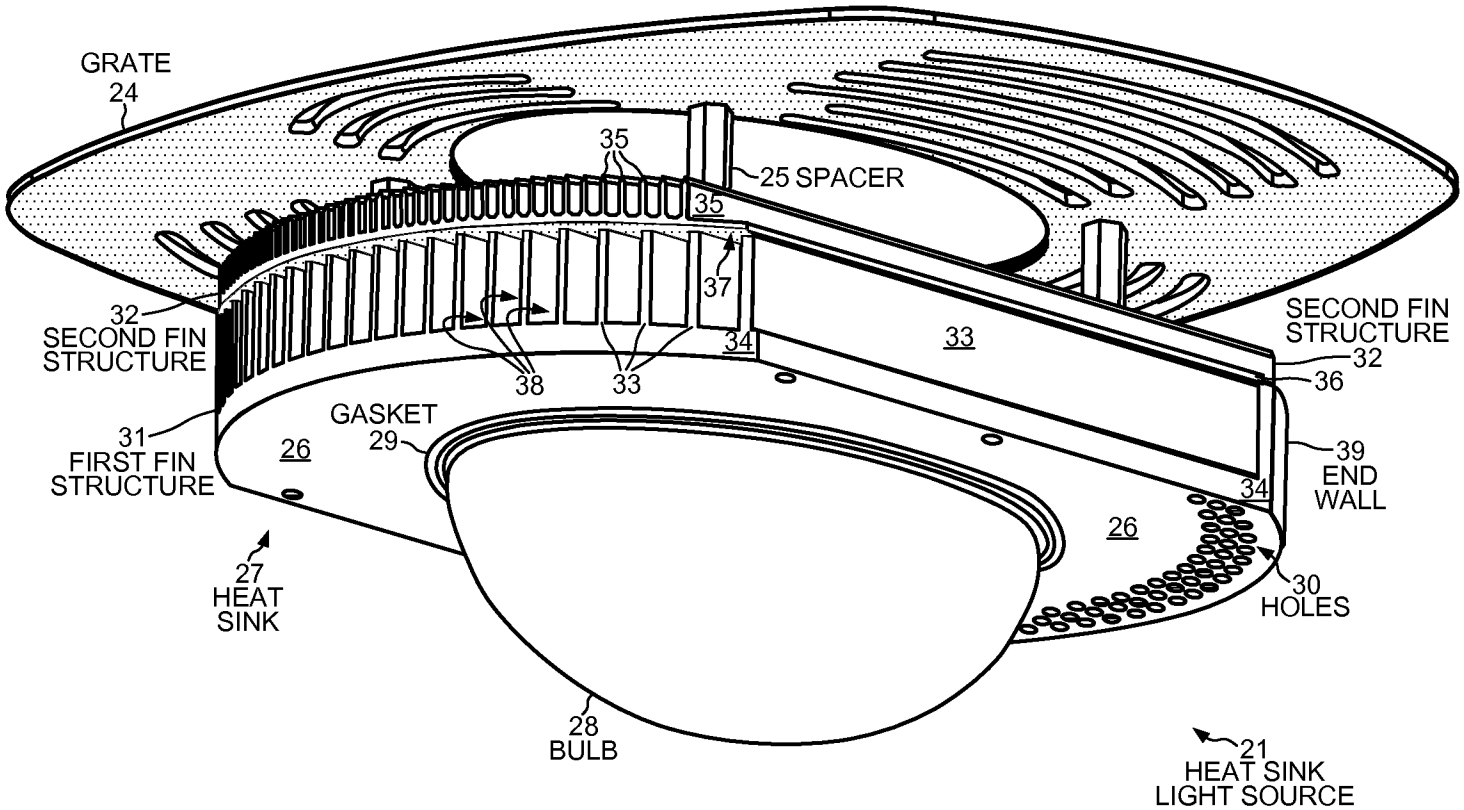
FIG. 3 is a more detailed perspective view the heat sink light source FIG. 2.

FIG. 3 is a more detailed perspective view of heat sink light source 21. Heat sink light source 21 includes a first fin structure 31 and a second fin structure 32. First fin structure 31 has a plurality of parallel-oriented larger fins 33 that are integrally formed with a first base 34. First base 34 has a first bottom surface 26 opposite the larger fins 33. First bottom surface 26 of first base 34 is also the bottom surface 26 of heat sink 27. Second fin structure 32 has a plurality of parallel-oriented smaller fins 35 that are integrally formed with a second base 36. Second base 36 has a second bottom surface 37 opposite the smaller fins 35. Second bottom surface 37 contacts the tops of the larger fins 33. Second fin structure 32 is bolted tightly to first fin structure 31 so as to ensure good thermal conductivity between larger fins 33 and bottom surface 37. The larger fins 33 are more than twice as tall as the smaller fins 35. For example, the larger fins 33 are more than six centimeters tall, whereas the smaller fins 35 are less than three centimeters tall. Ducts 38 are formed between the larger fins, the second bottom surface 37 and the first base 34. One end of each duct 38 is blocked by an end wall 39. End wall 39 is part of first base 34. The outside of end wall 39 is visible in FIG. 2. Intake holes 30 pass through first base 34 into each of the ducts 38 at the end of each duct that is blocked by end wall 39. In the embodiment of FIG. 3, three intake holes 30 open into each duct 38.

Heat generated by the LEDs attached to first bottom surface 26 is drawn into first fin structure 31 and heats the air between larger fins 33, thereby removing some of the thermal energy from surfaces of heat sink 27. The heated air then exits the open ends of the ducts 38, drawing cool air into the blocked ends of the ducts through the intake holes 30. The larger fins 33 are taller and wider apart than the smaller fins 35 in order to permit air to flow more easily through the ducts 38 in a horizontal direction. Some heat is transferred from first fin structure 31 to second fin structure 32 and heats the smaller fins 35. Heated air can rise vertically unobstructed over the shorter height of the smaller fins 35. Consequently, the smaller fins 35 can dissipate more heat despite having narrower channels between the fins, which permits more surface area over the entire second fin structure 32.

FIG. 3 also shows grate 24 from which heat sink light source 21 hangs. After installation, heat sink light source 21 is attached to the shell of street lamp 20 via grate 24 and is disposed below the shell. During installation, upper cover 22 of the shell of street lamp 20 is removed from lower cover 23, and the LED light source with the attached heat sink 21 is inserted from the inside of the shell through the opening (for the original lens) in lower cover 23 such that grate 24 rests on the inside lip of the opening. Grate 24 has an opening in the middle and curved slats that permit air to flow through the grate.

Figure 4A:
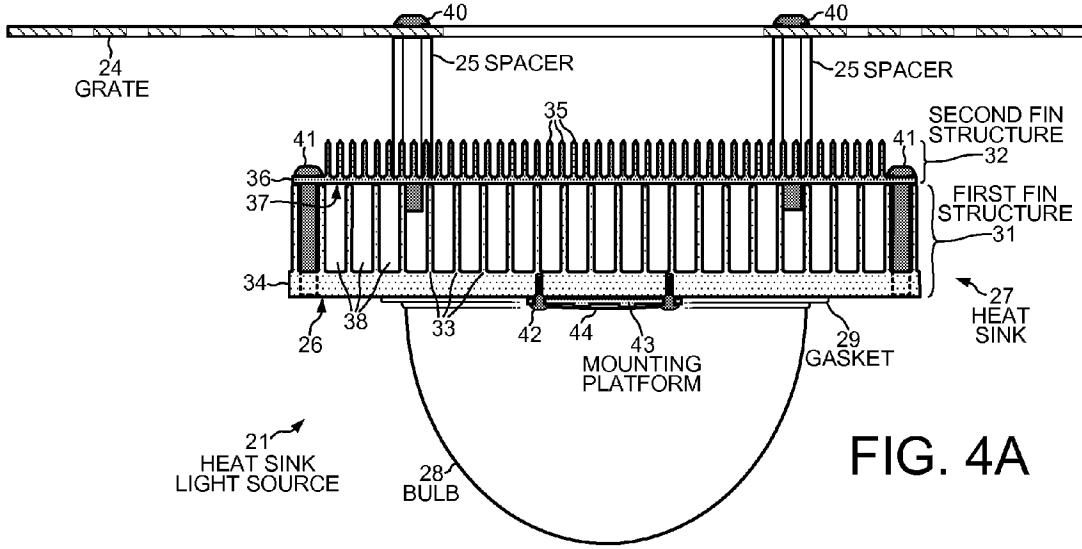
FIGS. 4A-B are cross sectional views of the heat sink light source of FIG. 2.
Figure 4B:
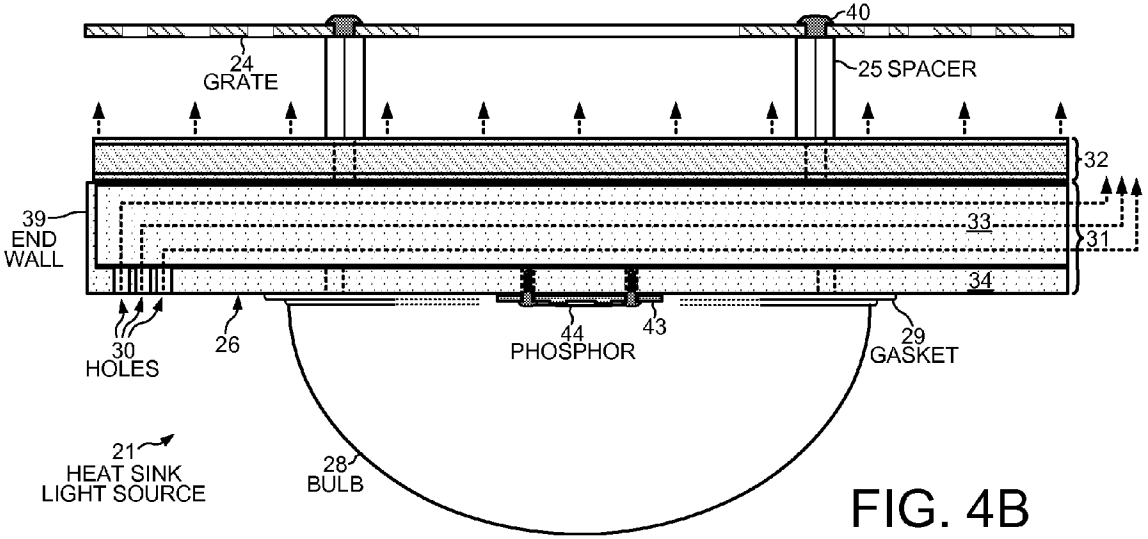

FIGS. 4A-B are cross sectional views of heat sink light source 21 attached to grate 24 by spacers 25. FIG. 4A is a cross sectional view looking parallel to the larger fins 33 and smaller fins 35 and down the ducts 38. FIG. 4A shows that there are more than twice as many smaller fins 35 disposed across second base 36 as there are larger fins 33 disposed across first base 34 per unit distance perpendicular to smaller fins 35. In FIG. 4A, there are thirty-five smaller fins 35 for each sixteen larger fins 33 in the dimension perpendicular to the fins. In an embodiment in which the larger fins 33 are about six centimeters tall, this is equivalent to about 1.17 smaller fins for each 0.53 larger fins per centimeter perpendicular to smaller fins 35.

FIG. 4A also shows that bolts 40 pass through the hollow center of spacers 25 and screw into the second base 36. Other bolts 41 pass through second base 36 and screw into first base 34. Yet other smaller bolts 42 attach a mounting platform 43 to first bottom surface 26 of first base 34. Mounting platform 43 is also attached to first bottom surface 26 using thermal grease that coats the surfaces between first fin structure 31 and mounting platform 43. The thermal grease also enhances the transfer of heat from mounting platform 43 to first fin structure 31. Mounting platform 43 is thermally conductive, yet electrically nonconductive. For example, platform 43 can be made of aluminum oxide ($Al_2O_3$) or aluminum nitride (AlN).

Light emitting diode (LED) dice are attached to the bottom surface of mounting platform 43 via a dielectric layer. The LED dice are covered by a layer of phosphor 44 that converts a portion of the blue light generated by the LEDs to light in the yellow region of the optical spectrum. The combination of the blue and yellow light is perceived as "white" light by a human observer. When heat sink light source 21 is installed, the light generated by the LED dice and the phosphor 44 shines downwards from mounting platform 43 through bulb 28 and onto the street below retrofitted street lamp 20.

Bulb 28 is attached to first bottom surface 26 by means of gasket 29 such that mounting platform 43 and the LEDs are enclosed by bulb 28 and first bottom surface 26. Gasket 29 can have several components, such as a wider ring with adhesive on both sides and a narrower, taller ring into which bulb 28 fits. The taller ring has openings through which wires and gas tubes can pass between the wider ring and bulb 28.

FIG. 4B is a cross sectional view of heat sink light source 21 looking perpendicular to the larger fins 33 and smaller fins 35. Heat that is generated by the LEDs and phosphor 44 is conducted through mounting platform 43 to first base 34 and larger fins 33 into the air in ducts 38. The expanding heated air exits the ducts 38 through the open ends opposite end wall 39 and draws cooler air into the ducts through the intake holes 30, as illustrated by the dashed lines in FIG. 4B. Air heated by smaller fins 35 rises straight up towards grate 24.

Figure 5:
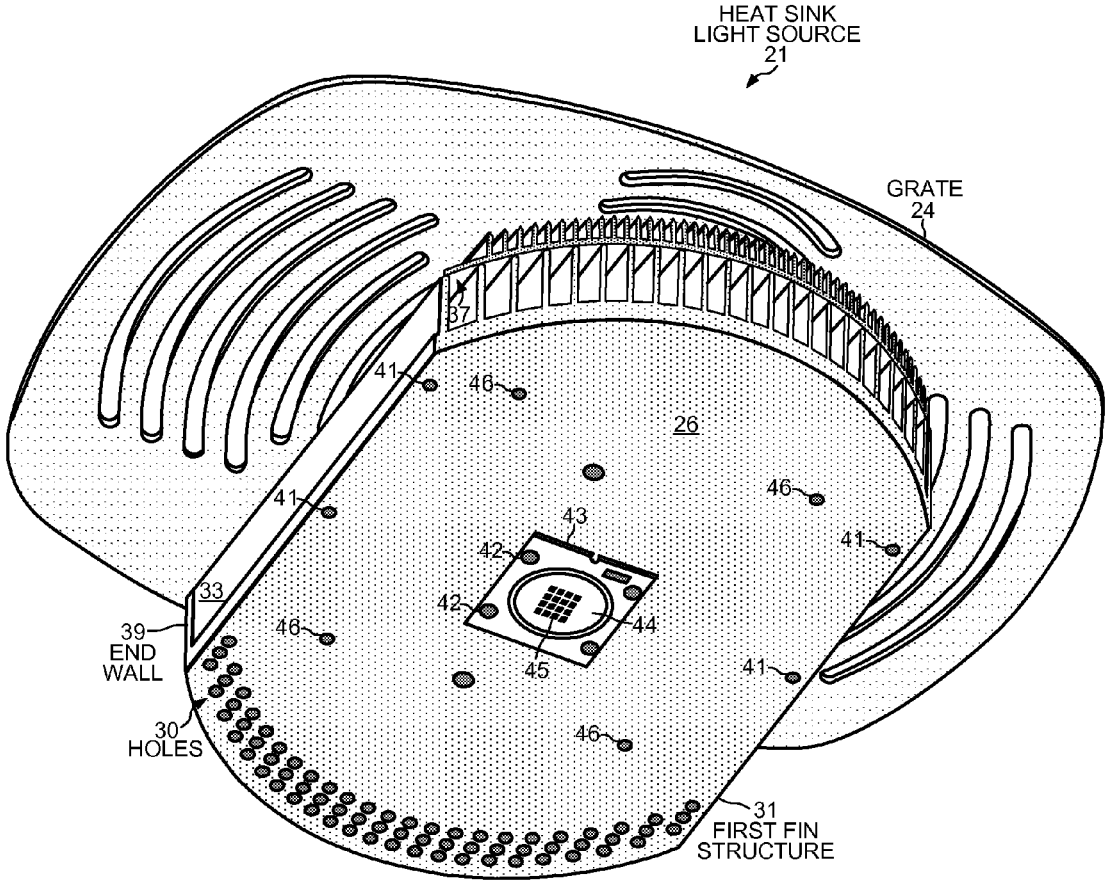
FIG. 5 is a perspective view from below the heat sink light source of FIG. 2 without the bulb.

FIG. 5 is a perspective view from below heat sink light source 21. Bulb 28 has been removed from the drawing of FIG. 5 in order to expose mounting platform 43 attached to first bottom surface 26 of first fin structure 31. In the embodiment of FIG. 5, bulb 28 is permanently attached to first bottom surface 26. LEDs 45 arranged in a 4×4 matrix are mounted to mounting platform 43 and are covered by a layer of phosphor 44. In another embodiment, the LEDs 45 are arranged in a 10×10 array. The four screw holes 46 in first bottom surface 26 are not used in the embodiment of FIG. 5. In another embodiment, however, bulb 28 and the LEDs 45 are not permanently attached to first bottom surface 26. Instead, mounting platform 43 and LEDs 45 are included in a replaceable LED bulb that bolts into the four screw holes 46.

Figure 6:
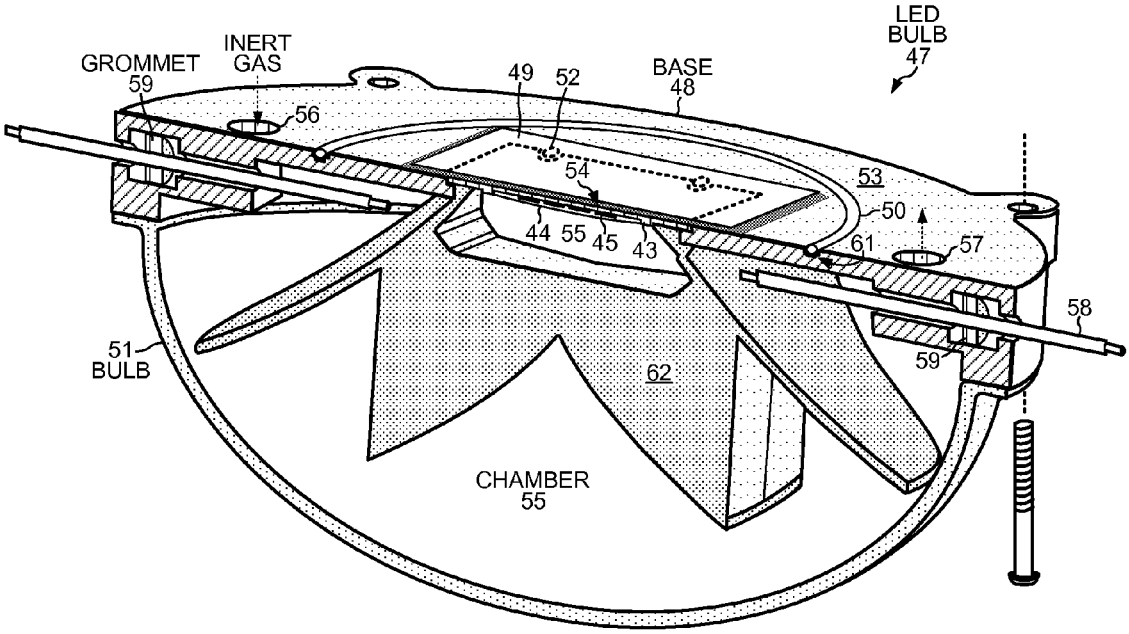
FIG. 6 is a cross sectional perspective view of a replaceable LED bulb that can be removably attached to a heat sink.

FIG. 6 is a cross sectional perspective view of a replaceable LED bulb 47 that can be removably attached to bottom surface 26 of heat sink 27. LED bulb 47 includes a base 48, a thermal pad 49, mounting platform 43, LEDs 45, a gasket 50 and a bulb 51. LEDs 45 are attached to mounting platform 43 in the same manner as in the embodiment of FIG. 5. Base 48 is made of metal, such as aluminum, or of ABS plastic. Mounting platform 43 snaps into four columns 52 that extend upward (in the orientation of FIG. 6) from protrusions from base 48 into indentations in mounting platform 43. Thermal pad 49 completely covers mounting platform 43 and a portion of the outside surface 53 of base 48. Mounting platform 43 has a first surface 54 opposite the LEDs 45 that is substantially coplanar with the portion of outside surface 53 of base 48 that is covered by thermal pad 49. In one embodiment, there is a shallow indentation in outside surface 53 that is approximately the same size and depth as the size and thickness of thermal pad 49. The indentation permits the outside surface of thermal pad 49 to be substantially coplanar with the remainder of the outside surface 53 of base 48. Adhesive around the edges of thermal pad 49 glues the pad to outside surface 53. Thermal grease is also used to attach thermal pad 49 over mounting platform 43 and over a portion of the outside surface 53.

A chamber 55 or enclosure is formed between base 48, mounting platform 43 and bulb 51. The LEDs 45 are disposed inside chamber 55. Chamber 55 is filled with nitrogen or an inert gas, such as argon, in order to protect the LEDs 45 and phosphor 44 from degradation. The nitrogen or inert gas is added through a first valved hole 56, and the air inside chamber 55 is expelled through a second valved hole 57. The valved holes 56-57 are closed after chamber 55 is filled with gas, and chamber 55 is hermetically sealed. The wires 58 that provide power to the LEDs 45 pass through holes in the sides of base 48. The wire holes include an expanded portion containing a grommet 59 through which the wires 58 pass. An epoxy adhesive 60 seals the small spaces between grommet 59 and the hole as well as between grommet 59 and the wires 58.

Before installation of LED bulb 47 on heat sink 27, the thermal grease and thermal pad 49 create a seal that prevents the inert gas from escaping chamber 55 around mounting platform 43. The thermal pad 49 and the epoxy adhesive 60 around grommets 59 are used to create the hermetic seal of chamber 55. The hermetic seal, however, may deteriorate over time. Over the long operational lifetime of LED bulb 47, the inert gas may escape chamber 55 by passing around mounting platform 43 and out from under thermal pad 49.

Thus, gasket 50 is used to create a lasting seal between outside surface 53 of base 48 and bottom surface 26 of heat sink 27. Although over time the inert gas may escape past mounting platform 43, the inert gas does not escape between outside surface 53 and bottom surface 26 beyond the seal created by gasket 50. Gasket 50 is disposed in a groove 61 in outside surface 53 of base 48. Gasket 50 is pressed into the corners of groove 61 to create a tight seal as LED bulb 47 is bolted onto heat sink 27 and outside surface 53 and bottom surface 26 are screwed together.

As LED bulb 47 is installed on heat sink 27, base 48 is bolted straight to the heat sink without rotating outside surface 53 of base 48 over bottom surface 26 of heat sink 27. Rotating LED bulb 47 while pressing outside surface 53 onto bottom surface 26 would twist thermal pad 49 and dislodge the seal formed around mounting platform 43 and thermal pad 49 that prevents the inert gas from escaping chamber 55. Thus, the non-twisting method of attaching LED bulb 47 to heat sink 27 allows a large thermal pad that can transfer over 100 Watts of heat energy to remain in place as LED bulb 47 is installed. Twist-on methods of attaching LED bulbs currently do not accommodate thermal pads between the LEDs and the external heat sink that can transfer a large amount of energy, for example, over 30 Watts.

FIG. 6 also shows that LED bulb 47 includes a reflector 62 that disburses the light generated by the LEDs 45 and phosphor 44 over a wider area on the ground below street lamp 20.

Figure 7:
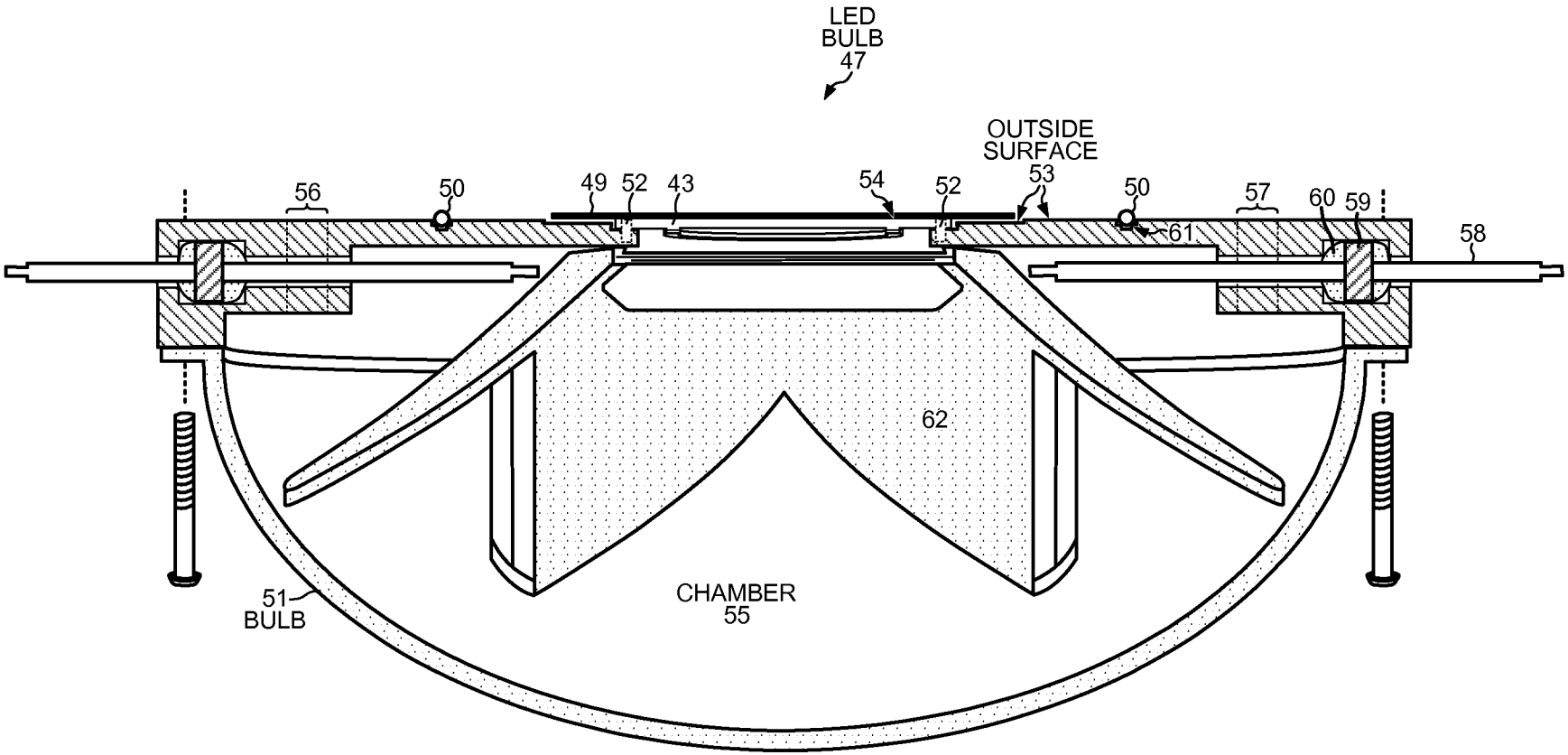
FIG. 7 is a more detailed cross sectional view of the LED bulb of FIG. 6.

FIG. 7 is a more detailed cross sectional view of LED bulb 47 of FIG. 6. FIG. 7 shows how thermal pad 49 completely covers mounting platform 43 and a portion of the outside surface 53 of base 48. FIG. 7 also shows how epoxy adhesive 60 seals the wire holes around grommet 59.

Figure 8:
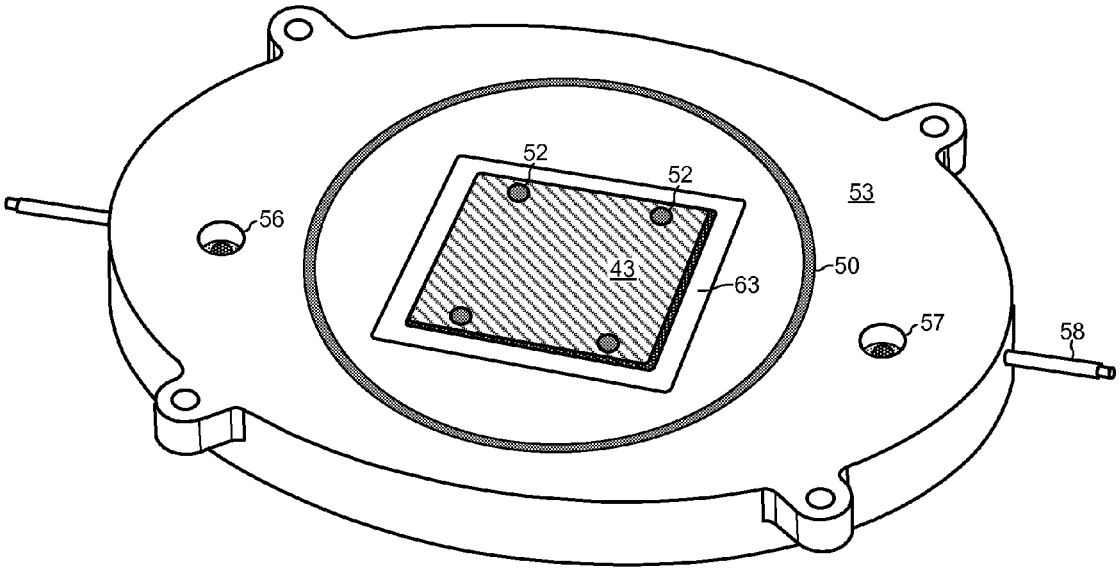
FIG. 8 is a perspective view of the outside surface of the base of the LED bulb of FIG. 6 opposite the bulb.

FIG. 8 is a perspective view of outside surface 53 of base 48. Thermal pad 49 has been removed from the drawing of FIG. 8 to reveal mounting platform 43 that has been snapped down over the four columns 52 that extend upwards from protrusions in base 48 into holes in mounting platform 43. FIG. 8 shows the shallow indentation 63 in outside surface 53 that is approximately the same area and depth as the area and thickness of thermal pad 49.

Figure 9:
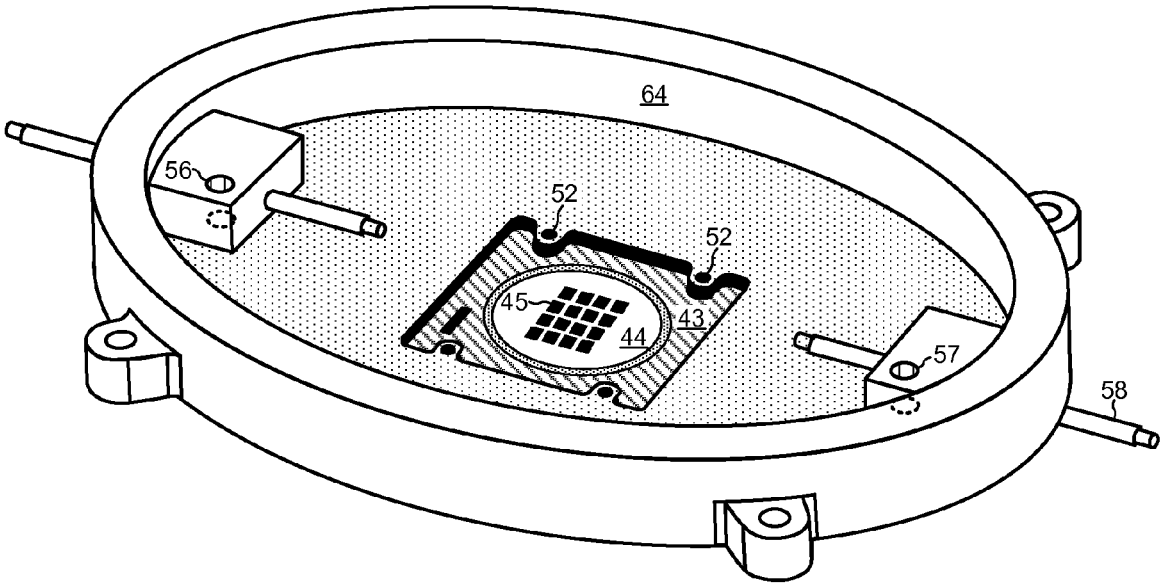
FIG. 9 is a perspective view of the opposite side of the base of the LED bulb shown in FIG. 8.

FIG. 9 is a perspective view of the opposite side of base 48 as that shown in FIG. 8. FIG. 9 shows mounting platform 43 that has been snapped into the four columns 52 that extend from protrusions in base 48. The layer of phosphor 44 within the round containing ring on mounting platform 43 covers the LED dice 45. With bulb 51 removed from the drawing of FIG. 9, a ringed wall 64 of base 48 is visible to which bulb 51 attaches.

Figure 10:
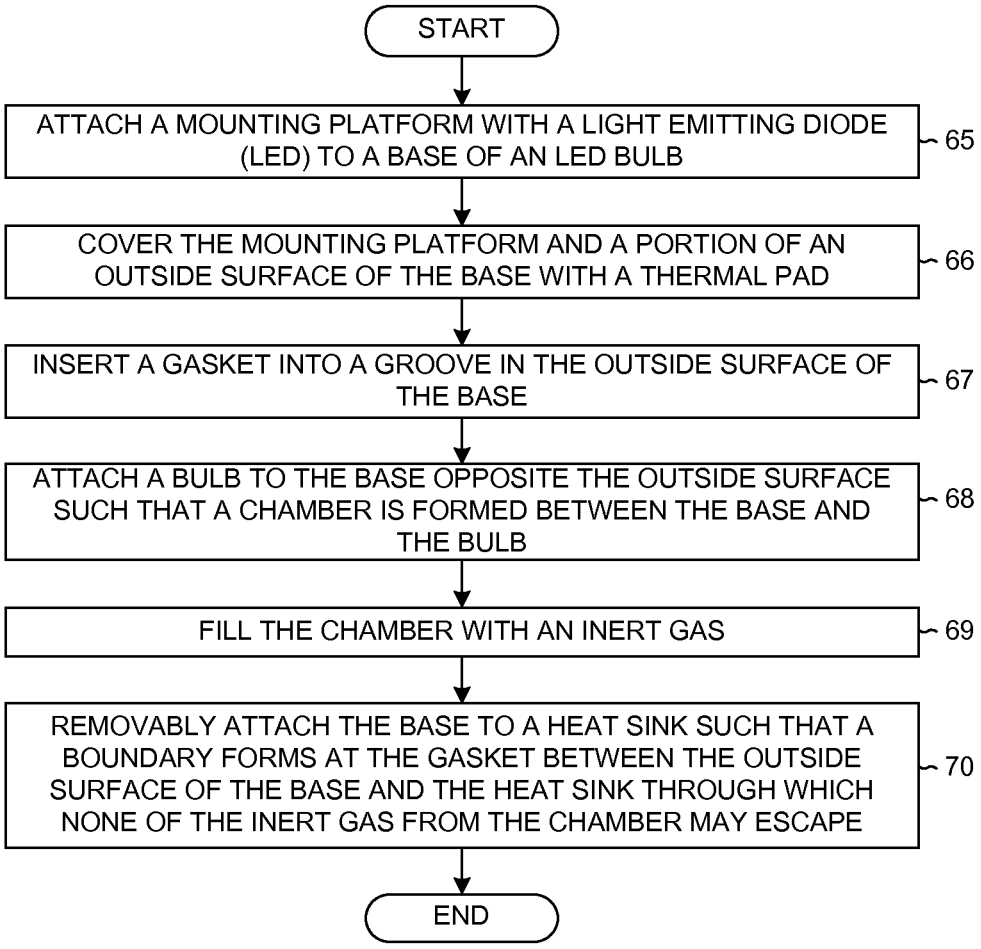
FIG. 10 is a flowchart of steps for manufacturing the replaceable LED light bulb of FIG. 6.

FIG. 10 is a flowchart illustrating steps 65-70 of a method of making a replaceable LED light bulb for a street lamp. The LED light bulb can be replaced independently of the associated heat sink that remains attached to the street lamp.

In a first step 65, mounting platform 43 is attached to base 48 of LED bulb 47. At least one LED die is attached to mounting platform 43 before the platform is attached to the base of LED bulb 47. Mounting platform 43 is attached to base 48 by snapping the platform into support columns 52 that extend from base 48. Mounting platform 43 is attached to base 48 from outside surface 53 and covers a rectangular opening in base 48.

In step 66, mounting platform 43 is completely covered from outside surface 53 (opposite the LED) by thermal pad 49. Thermal pad 49 also covers a portion of the outside surface that frames mounting platform 43. An adhesive glues the edges of thermal pad 49 to outside surface 53. In addition, thermal grease is used to attach thermal pad 49 to mounting platform 43 and to outside surface 53.

In step 67, gasket 50 is inserted into groove 61 in outside surface 53 of base 48. Upon installation, gasket 50 is used to create a tight seal between outside surface 53 of LED bulb 47 and bottom surface 26 of heat sink 27, which is attached to street lamp 20.

In step 68, bulb 51 is attached to ringed wall 64 of base 48 opposite outside surface 53. Attaching bulb 51 forms chamber 55 between base 48, mounting platform 43 and bulb 51.

In step 69, chamber 55 is filled with an inert gas, such as argon. The inert gas is added to chamber 55 through first valved hole 56, and the air inside chamber 55 is expelled through second valved hole 57. After about five minutes of pumping the inert gas into chamber 55, nearly all of the ambient air in the chamber has been expelled, and the chamber contains more than 99% inert gas. Chamber 55 is then hermetically sealed.

In step 70, base 48 of LED bulb 47 is removably attached to double-plated heat sink 27 such that gasket 50 forms a boundary between outside surface 53 of base 48 and bottom surface 26 of heat sink 27 through which none of the inert gas from chamber 55 that passes from chamber 55 around mounting platform 43 may escape beyond the boundary.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus, comprising:

a first fin structure with a first number of parallel oriented larger fins integrally formed with a first base, wherein the first base has a first bottom surface opposite the larger fins;

a second fin structure with a second number of parallel oriented smaller fins integrally formed with a second base, wherein the second base has a second bottom surface opposite the smaller fins, wherein the second bottom surface contacts the larger fins, wherein the larger fins are oriented parallel to the smaller fins, wherein the larger fins are taller than the smaller fins, wherein there are more smaller fins disposed across the second base than there are larger fins disposed across the first base, wherein ducts are formed between the larger fins, the second bottom surface and the first base, wherein a first end of each duct is blocked by an end wall, and wherein an intake hole passes through the first base into each duct at the first end of each duct; and a light emitting diode (LED) attached adjacent to the first bottom surface.

2. The apparatus of claim 1, further comprising:

a mounting platform attached to the first bottom surface, wherein the mounting platform is disposed between the first bottom surface and the LED.

3. The apparatus of claim 2, wherein the mounting platform is attached to the first bottom surface using thermal grease.

4. The apparatus of claim 1, further comprising:

a bulb attached to the first bottom surface, wherein the LED is enclosed by the bulb and the first bottom surface.

5. The apparatus of claim 4, wherein an enclosure between the bulb and the first bottom surface is hermetically sealed.

6. The apparatus of claim 1, wherein the second fin structure is made of extruded aluminum.

7. An apparatus, comprising:

a heat sink including:

a first fin structure with parallel oriented larger fins integrally formed with a first base, wherein the first base has a first bottom surface opposite the larger fins; and a second fin structure with parallel oriented smaller fins integrally formed with a second base, wherein the second base has a second bottom surface opposite the smaller fins, wherein the second bottom surface contacts the larger fins, wherein the larger fins are taller than the smaller fins, wherein ducts are formed between the larger fins, the second bottom surface and the first base, and wherein an intake hole passes through the first base into each of the ducts; and a shell of a street lamp, wherein the heat sink is attached to the shell and is disposed below the shell.

8. The apparatus of claim 7, wherein the heat sink is externally mounted to the shell by spacers attached to the second fin structure.

9. The apparatus of claim 7, wherein a light emitting diode is attached to the first bottom surface.

10. The apparatus of claim 7, wherein the heat sink further includes a bulb attached to the first bottom surface, and wherein a light emitting diode is enclosed by the bulb and the first bottom surface.

11. The apparatus of claim 10, wherein an enclosure between the bulb and the first bottom surface is hermetically sealed.

12. The apparatus of claim 7, wherein the larger fins are oriented parallel to the smaller fins, and wherein there are more than twice as many smaller fins disposed across the first base as there are larger fins disposed across the second base per unit distance perpendicular to the smaller fins.

13. The apparatus of claim 7, wherein the heat sink attaches on the inside of the shell and hangs down below the shell.

14. An apparatus comprising:

a base with a planar outside surface;

a gasket disposed in a groove in the planar outside surface;

a light emitting diode (LED) attached to the base; and a bulb, wherein a chamber is formed between the base and the bulb, wherein the LED is disposed inside the chamber, and wherein the chamber is hermetically sealed.

15. The apparatus of claim 14, wherein the LED is not disposed on the planar outside surface, and wherein the gasket is used to hermetically seal the chamber.

16. The apparatus of claim 14, wherein the apparatus is removably attached to a heat sink, and wherein the heat sink is permanently attached to a street lamp.

17. The apparatus of claim 14, wherein the apparatus is removably attached to a heat sink, and wherein the gasket forms an air-tight boundary between the outside surface of the base and the heat sink such that no gas may escape from the chamber through the base beyond the boundary of the gasket.

18. A method of manufacturing, comprising:

attaching a light emitting diode (LED) to a base having a planar outside surface;

inserting a gasket into a groove in the planar outside surface;

attaching a bulb to the base opposite the planar outside surface, wherein a chamber is formed between the base and the bulb;

removing ambient air from the chamber; and filling the chamber with an inert gas.

19. The method of claim 18, further comprising:

removably attaching the base to a heat sink such that a boundary forms at the gasket between the planar outside surface of the base and the heat sink through which none of the inert gas contained within the chamber may escape.

20. The method of claim 18, further comprising:

removably attaching the base to a heat sink; and forming an air-tight boundary between the planar outside surface of the base and the heat sink using the gasket such that no gas may escape from the chamber beyond the gasket.

* * * * *